US007113719B2

(12) United States Patent
Kubota

(10) Patent No.: US 7,113,719 B2
(45) Date of Patent: Sep. 26, 2006

(54) IMAGE FORMING APPARATUS

(75) Inventor: Tsutomu Kubota, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/990,854

(22) Filed: Nov. 16, 2004

(65) Prior Publication Data

US 2005/0111865 A1 May 26, 2005

(30) Foreign Application Priority Data

Nov. 20, 2003 (JP) ..... 2003-391119

(51) Int. Cl.
*G03G 15/20* (2006.01)

(52) U.S. Cl. ..... 399/70; 399/67; 399/68; 399/69; 399/168

(58) Field of Classification Search ..... 399/70, 399/83, 67, 68, 69, 77
See application file for complete search history.

(56) References Cited

U.S. PATENT DOCUMENTS 5,608,493 A * 3/1997 Tanaka et al. ..... 399/83
5,771,421 A * 6/1998 Kim ..... 399/44
5,987,274 A * 11/1999 Satoh ..... 399/69
6,246,846 B1 * 6/2001 Hanashi ..... 399/70
6,304,734 B1 * 10/2001 Teranishi et al. ..... 399/82

FOREIGN PATENT DOCUMENTS

JP 61-145479 A 7/1986
JP 7-251550 A 3/1995
JP 2001-201986 A 7/2001
JP 2002-072761 A 3/2002
JP 2002-077478 A 3/2002
JP 2002-099400 A 4/2002
JP 2002-296952 A 10/2002

* cited by examiner

*Primary Examiner*—Arthur T. Grimley
*Assistant Examiner*—Joseph S. Wong
(74) *Attorney, Agent, or Firm*—Canon U.S.A. Inc IP Division

(57) ABSTRACT

An image forming apparatus operable to perform functions. The functions include a function involving a printing operation. The apparatus includes an activator for activating a function. A determiner determines whether the activated function is the function involving the printing operation. The apparatus includes an image forming unit for forming an image on a print medium. A fuser can fuse the image on the print medium with heat. A controller controls the fuser to start heating if the activated function involves the printing operation.

15 Claims, 9 Drawing Sheets

FIG. 4

| FUNCTION | PRINT OPERATION |
|---|---|
| COPY | ON |
| PRINT | ON |
| FAX RECEIVE | ON |
| FAX SEND | OFF |
| NETWORK DATA RECEIVE | OFF |
| NETWORK DATA SEND | OFF |

FIG. 9

| | FOLLOW THE SETTING | DO NOT HEAT FUSER | HEAT FUSER |
|---|---|---|---|
| AT POWER-ON | | | |
| ON RECOVERY FROM SLEEP MODE | | | |

FIG. 10

| | LEVEL 1 | LEVEL 2 | LEVEL 3 |
|---|---|---|---|
| ESTIMATED RECOVERY TIME | 20 sec | 1 min | 3 min |
| SET TRANSITION TIME UNTIL SLEEP MODE | | | |

FIG. 11

| | OUTPUT IMMEDIATELY | OUTPUT PERIODICALLY | OUTPUT AT RECOVERY |
|---|---|---|---|
| HANDLING OF FAX RECEIVED DURING NIGHTTIME | | | |

IMAGE FORMING APPARATUS

This application claims priority from Japanese Patent Application No. 2003-391119 filed Nov. 20, 2003, which is hereby incorporated by reference herein.

BACKGROUND OF THE INVENTION

1. Field of the Invention

The present invention relates to a multifunction peripheral including a fuser, to an image forming apparatus, to a method for controlling the image forming apparatus, to a program, and to a storage medium.

2. Description of the Related Art

Hitherto, a fuser is provided in an image forming apparatus, such as a laser-beam printer, which forms images on paper by electrophotography. The fuser includes a heater and heats a toner image on paper with the heater at a fusing temperature, thereby fusing the toner image to the paper.

In an image forming apparatus including such a fuser, heating of the fuser starts at substantially the same time as the power is turned on, and the temperature of the fuser is raised to the fusing temperature. When a certain period of time has elapsed after the completion of image formation, the image forming apparatus goes into sleep mode, where the temperature of the fuser is lowered to a predetermined temperature lower than the fusing temperature and is maintained. Low power consumption in sleep mode can thus be achieved. To return from sleep mode, heating of the fuser starts again and the temperature of the fuser is raised to a fusing temperature (see, for example, Japanese Patent Laid-Open No. 7-251550).

A fuser is similarly controlled in a digital multifunction peripheral that performs multiple functions, such as faxing and data sending and receiving, in addition to copying and printing.

In a multifunction peripheral, fax sending and data sending operations require no image-forming operations, even if performed at power-on or at the time of returning from sleep mode. As such, the fuser is unnecessarily heated to reach the fusing temperature and power is wasted. In particular, if a fuser absorbing a large amount of heat is used, the amount of wasted power increases.

To minimize such waste of power, conditions of heating the fuser for each apparatus need to be changed depending on the usage environment of the apparatus, for example, the main types of functions to be performed and the frequency of use of each function. However, setting different heating conditions of a fuser for each apparatus cannot be easily achieved at the current technology level.

SUMMARY OF THE INVENTION

The present invention is directed to an apparatus operable to perform functions including a function involving a printing operation and to start heating of a fuser only when the function involves the printing operation.

In one aspect, an apparatus operable to perform functions including a function involving a printing operation on a print medium. The apparatus includes an activator activating a function; a determiner determining whether the activated function is the function involving the printing operation; an image forming unit operable to form an image on the print medium; a fuser heating the image formed on the print medium so as to fuse the image on the print medium; and a controller controlling the fuser to start heating responsive to the determiner determining that the activated function is the function involving the printing operation.

In another aspect, a method for controlling an apparatus operable to perform functions and having a fuser, the method comprising the steps of: activating a function; determining whether or not the function to be activated involves a printing operation; and responsive to determining that the function to be activated involves the printing function, heating the fuser.

Further features and advantages of the present invention will become apparent from the following description of the embodiments with reference to the attached drawings.

BRIEF DESCRIPTION OF THE DRAWINGS

FIG. 4 is a table showing the relationship between each function and the print operation in the printer section of the multifunction peripheral in FIG. 1.

FIG. 5 is a flowchart showing the operation when the multifunction peripheral in FIG. 1 is turned on.

FIG. 9 is a table for setting conditions for heating a fuser in a multifunction peripheral according to a fourth embodiment of the present invention.

FIG. 10 is a table for setting a time for transition from heating of a fuser to sleep mode in a multifunction peripheral according to a fifth embodiment of the present invention.

FIG. 11 is a table for setting the output timing of fax data received in a multifunction peripheral according to a sixth embodiment of the present invention.

DESCRIPTION OF THE EMBODIMENTS

Embodiments of the present invention will now be described with reference to the drawings.

First Embodiment

Figure 1:
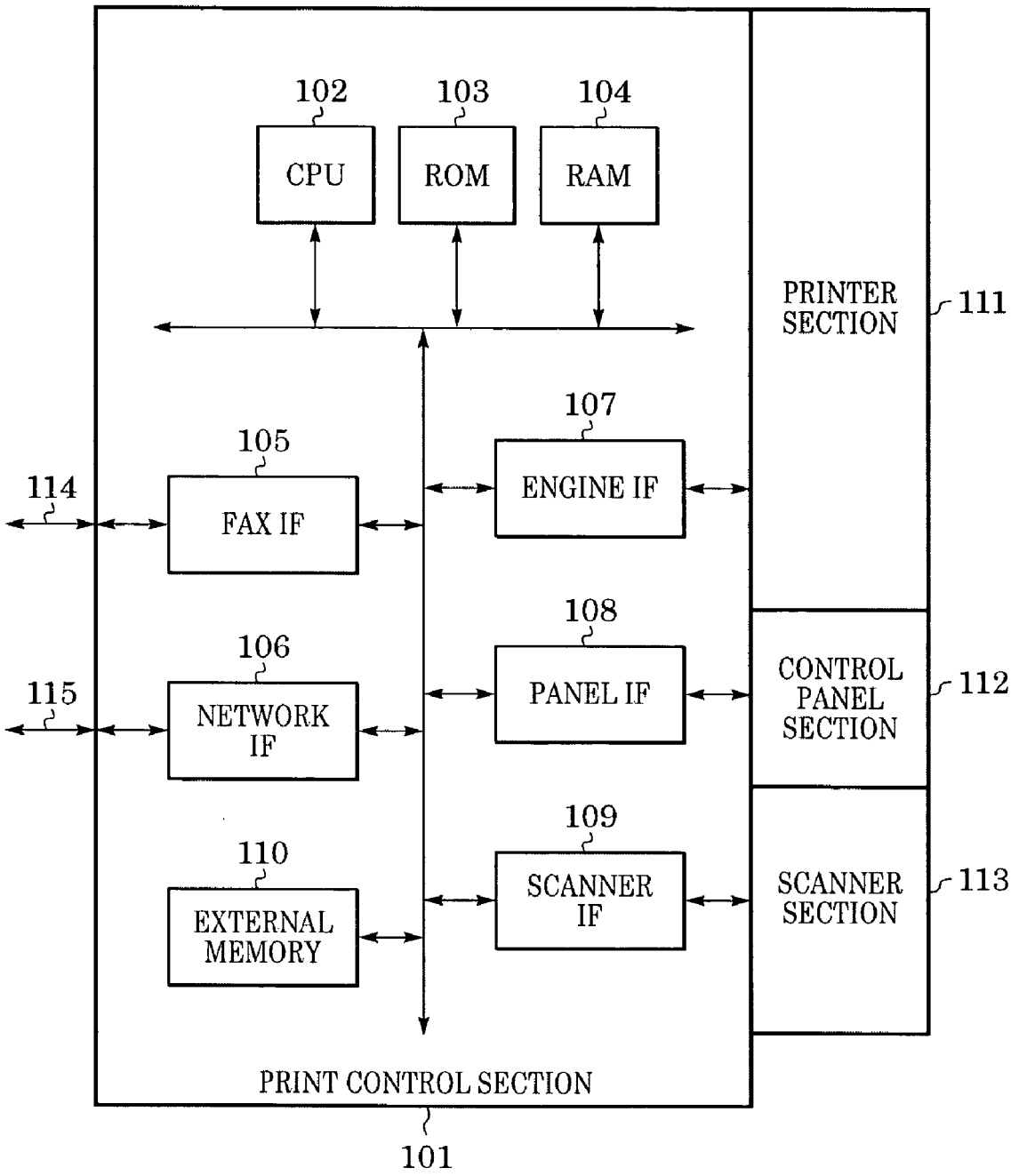
FIG. 1 is a block diagram of a multifunction peripheral according to a first embodiment of the present invention.

FIG. 1 is a block diagram of a multifunction peripheral according to a first embodiment of the present invention. In the present embodiment, a digital copier incorporating an electrophotograpic printer engine will be described as a multifunction peripheral of the present invention.

As shown in FIG. 1, the digital copier includes a print control section 101 for controlling multiple functions, such as copying, printing, and faxing. The print control section 101 includes a CPU 102, a ROM 103, a RAM 104, a fax interface (fax IF) 105, a network interface (network IF) 106, an engine interface (engine IF) 107, a panel interface (panel IF) 108, a scanner interface (scanner IF) 109, and an external memory 110.

The CPU 102 performs control for achieving multiple functions based on, for example, control programs stored in the ROM 103. The RAM 104 provides, for example, a work area for the CPU 102. The fax interface 105 is an interface connected to a phone line 114 and is provided for fax communication via the phone line 114. The network interface 106 is an interface connected to a network 115, such as a LAN, and is provided for data communication via the network 115. The engine interface 107 is an interface for controlling a printer section 111 for forming images on paper and is provided for input/output of, for example, print data and control commands to/from the printer section 111. The panel interface 108 is an interface provided for data input/output to/from a control panel section 112. The scanner interface 109 is an interface for controlling a scanner section 113 for reading image information in a document and is provided for input/output of, for example, data read and control commands to/from the scanner section 113. The external memory 110 is a memory device storing print data and electronic data.

The printer section 111 receives print data through the engine interface 107, while maintaining timing, and forms an image on paper based on the print data received. The control panel section 112 includes a display and switches to provide users with an interface. The scanner section 113 reads an image in a document and outputs data of the image.

Figure 2:
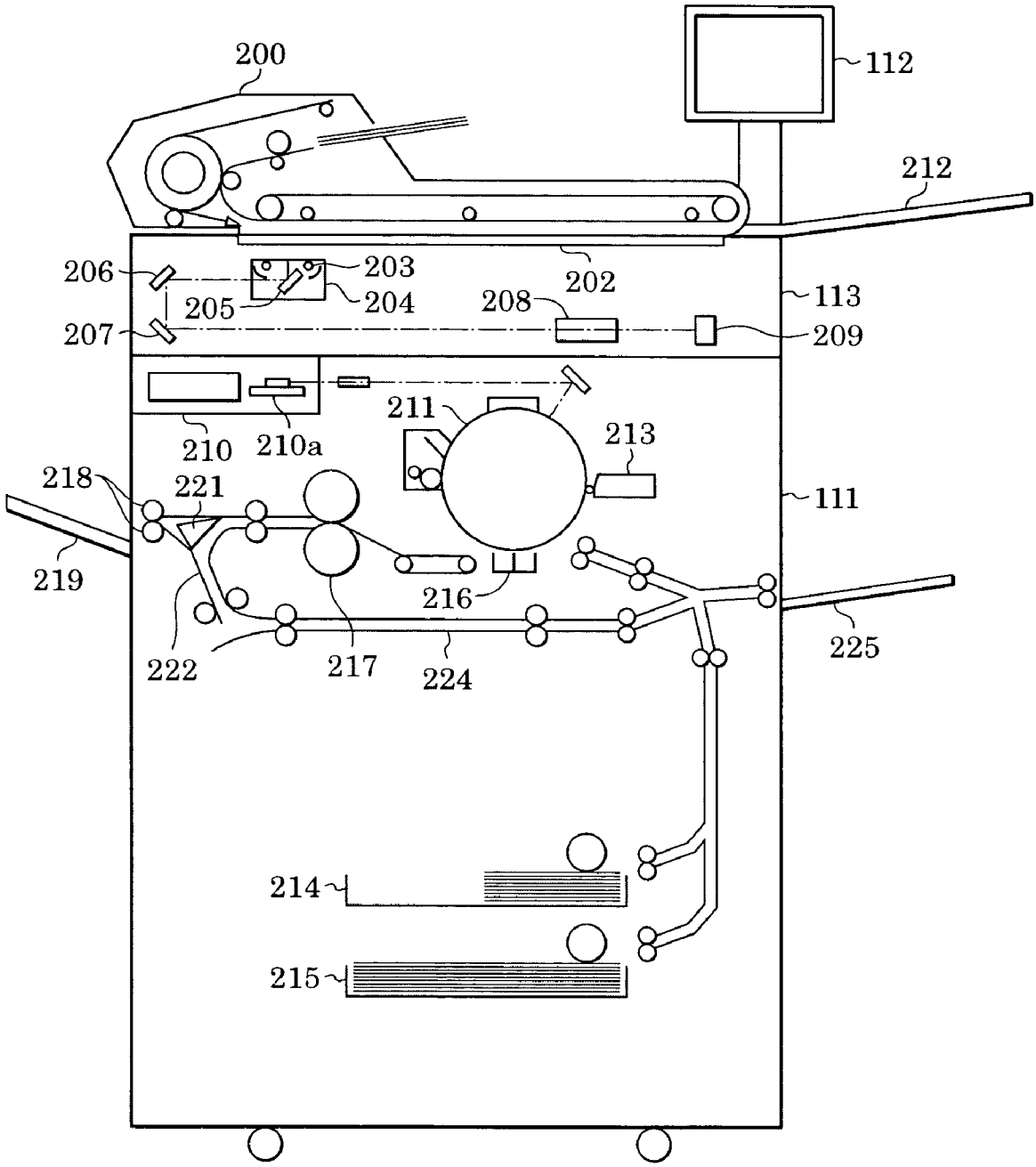
FIG. 2 is a vertical cross-sectional view showing the hardware structure of a scanner section and a printer section in FIG. 1.

The hardware structure of the scanner section 113 and the printer section 111 will now be described with reference to FIG. 2. FIG. 2 is a vertical cross-sectional view the hardware structure of the scanner section 113 and the printer section 111 in FIG. 1.

As shown in FIG. 2, the scanner section 113 is integrated with the printer section 111. The scanner section 113 incorporates a document feeder 200. The document feeder 200 feeds documents placed face-up on a document tray to the left, one by one from the top page. Then, the document feeder 200 allows the documents to pass through a bent path and flow over the surface of a glass platen 202 from left to right, via a so-called skimming point, and then ejects the documents toward an external output tray 212. When a document passes through the skimming point on the glass platen 202 from left to right, an image in the document is read by a scanner unit 204 held at a position corresponding to the skimming point. This reading method is generally referred to as document skimming. Specifically, when a document passes the skimming point, light from a lamp 203 of the scanner unit 204 is applied to a face of the document to be read, and light reflected off the document is directed through mirrors 205, 206, and 207 to a lens 208. Light passing through the lens 208 forms an image on an imaging area of an image sensor 209. The image sensor 209 converts the image into electronic signals and outputs them. The electronic signals outputted from the image sensor 209 undergo predetermined processing in the print control section 101 and are inputted into an exposure controller 210 of the printer section 111 as video signals.

Alternatively, an image in a document may be read at a fixed position. In this case, the document is conveyed by the document feeder 200 and stopped at a predetermined position on the glass platen 202. Then, the scanner unit 204 scans the document from left to right so as to read image information in the document. When the document is directly placed on the glass platen 202, image information therein can be read without using the document feeder 200.

The exposure controller 210 of the printer section 111 modulates a laser beam based on inputted video signals. The laser beam is then outputted from the exposure controller 210 and applied to a photoconductive drum 211 via a polygon mirror 210*a*. An electrostatic latent image corresponding to the scanned laser beam is formed on the photoconductive drum 211.

The electrostatic latent image on the photoconductive drum 211 is visualized as a developing-agent image with developing agent supplied from a developing unit 213. In synchronization with the beginning of the application the laser beam, sheets of paper start to be fed from a cassette 214 or 215, a manual feeder 225, or a double-sided conveyance path 224 and are carried to the position between the photoconductive drum 211 and a transferring unit 216. The developing-agent image formed on the photoconductive drum 211 is transferred onto a sheet of paper by the transferring unit 216.

The sheet of paper onto which the developing-agent image is transferred is carried to a fuser 217, which fuses the developing-agent image to the sheet of paper by applying thermal pressure to the fuser 217. Then, the sheet of paper passes through the fuser 217, lead to a flapper 221 and an ejection roller 218, and ejected to an output tray 219.

If double-sided recording for forming images on both sides of paper is designated, the sheet of paper is led to a reversing path 222 by a switching operation of the flapper 221, and is carried to the double-sided conveyance path 224. The sheet of paper is then fed to the position between the photoconductive drum 211 and the transferring unit 216 again, with the timing described above.

Figure 3A:
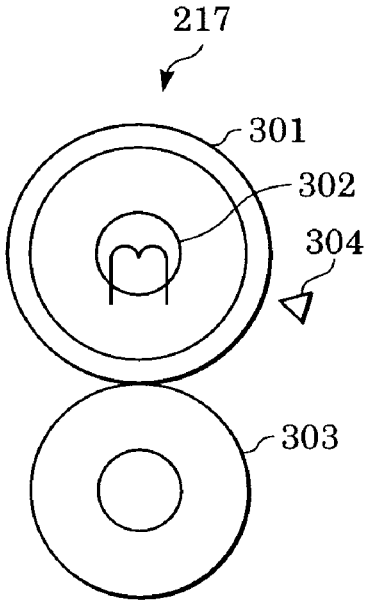
FIGS. 3A and 3B are schematic drawings of the fuser shown in FIG. 2.
Figure 3B:
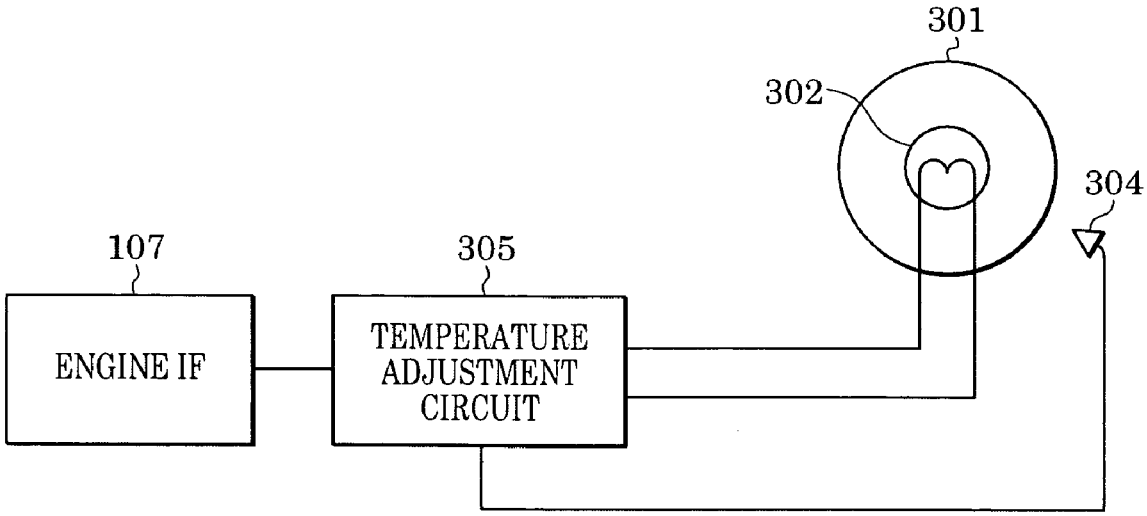

The structure of the fuser 217 will now be described with reference to FIGS. 3A and 3B. FIGS. 3A and 3B are schematic drawings of the fuser 217 in FIG. 2.

As shown in FIG. 3A, the fuser 217 is a fusing device including a halogen heater 302 serving as a heat source. The halogen heater 302 is incorporated in a fuser roller 301. A pressing mechanism (not shown) presses a pressure roller 303 against the fuser roller 301 with a predetermined pressing force such that the pressure roller 303 can rotate by being driven by the fuser roller 301. A nip for conveying sheets of paper is provided between the fuser roller 301 and the pressure roller 303. The width of the nip can be changed according to the strength of the above-described pressing force. Moreover, a thermal sensor 304 is provided in the vicinity of the surface of the fuser roller 301. The output of the thermal sensor 304 is inputted in a temperature adjustment circuit 305 described below.

Although a single halogen heater 302 is provided in the fuser 217 described above, a plurality of halogen heaters can be incorporated therein.

As shown in FIG. 3B, the halogen heater 302 is driven and controlled by the temperature adjustment circuit 305. Based on control signals inputted via the engine interface 107 and the output from the thermal sensor 304, the temperature adjustment circuit 305 regulates the amount of power supplied to the halogen heater 302 by constant-voltage control.

As described above, the functions provided in the present embodiment are copying, printing, faxing, and network data transmission. The relationship between each of these functions and the print operation of the printer section 111 will now be described with reference to FIG. 4. FIG. 4 is a table showing the relationship between each function and the print operation in the printer section 111 of the multifunction peripheral in FIG. 1.

In a copy function, the scanner section 113 reads a document, and the printer section 111 forms an image on a sheet of paper based on image data obtained by the scanner section 113.

In a print function, the printer section 111 receives print data from a network computer via the network interface 106 and forms an image on a sheet of paper based on the print data received.

A fax function includes a fax receiving function and a fax sending function. In the fax receiving function, the printer section 111 receives fax data via the fax interface 105 and forms an image on a sheet of paper based on the fax data received. In the fax sending function, the scanner section 113 reads a paper document, converts the obtained data to fax data, and outputs it via the fax interface 105.

A network data transmission function includes a network data receiving function and a network data sending function. In the network data receiving function, data received from an apparatus on a network via the network interface 106 is written into the external memory 110 and stored. In the network data sending function, the scanner section 113 reads a document, and image data obtained is outputted to an apparatus on a network via the network interface 106. Moreover, in the network data sending function, data stored in the external memory 110 can be outputted to the apparatus on the network via the network interface 106.

In the present embodiment, as shown in FIG. 4, each of the functions, that is, copying, printing, faxing, and network data transmission is associated with the need for the print operation performed in the printer section 111. This correspondence is maintained, for example, in the external memory 110 in the form of a table. In the present embodiment, the need for heating the fuser 217 in the printer section 111 is determined based on the function to be activated at power-on. Specifically, when any of copying, printing, and fax receiving is set as a function to be activated at power-on, heating of the fuser 217, that is, power supply to the halogen heater 302 starts, and the fuser 217 is heated to the fusing temperature, since these functions involve the print operation by the printer section 111. On the other hand, when either of fax sending and network data transmission is set up as a function to be activated at power-on, heating of the fuser 217 to a fusing temperature is not performed, since these functions involve no print operation by the printer section 111.

After a function set to be activated at power-on is activated and a user selects a function, such as a copy function, which involves the print operation by the printer section 111, power supply to the halogen heater 302 of the fuser 217 starts, and the fuser 217 is heated to a fusing temperature.

A function to be activated at power-on is predetermined and an initial-state setting indicating the function is stored in the external memory 110. This initial-state setting can be set, in the control panel section 112, by the input operation of the user. Specifically, when a selection screen for selecting any of copying, printing, faxing, and network data transmission as a function to be activated at power-on is displayed and any of these functions is selected on the screen, a value corresponding to the selected function is stored, as the initial-state setting, in the external memory 110.

Figure 5:
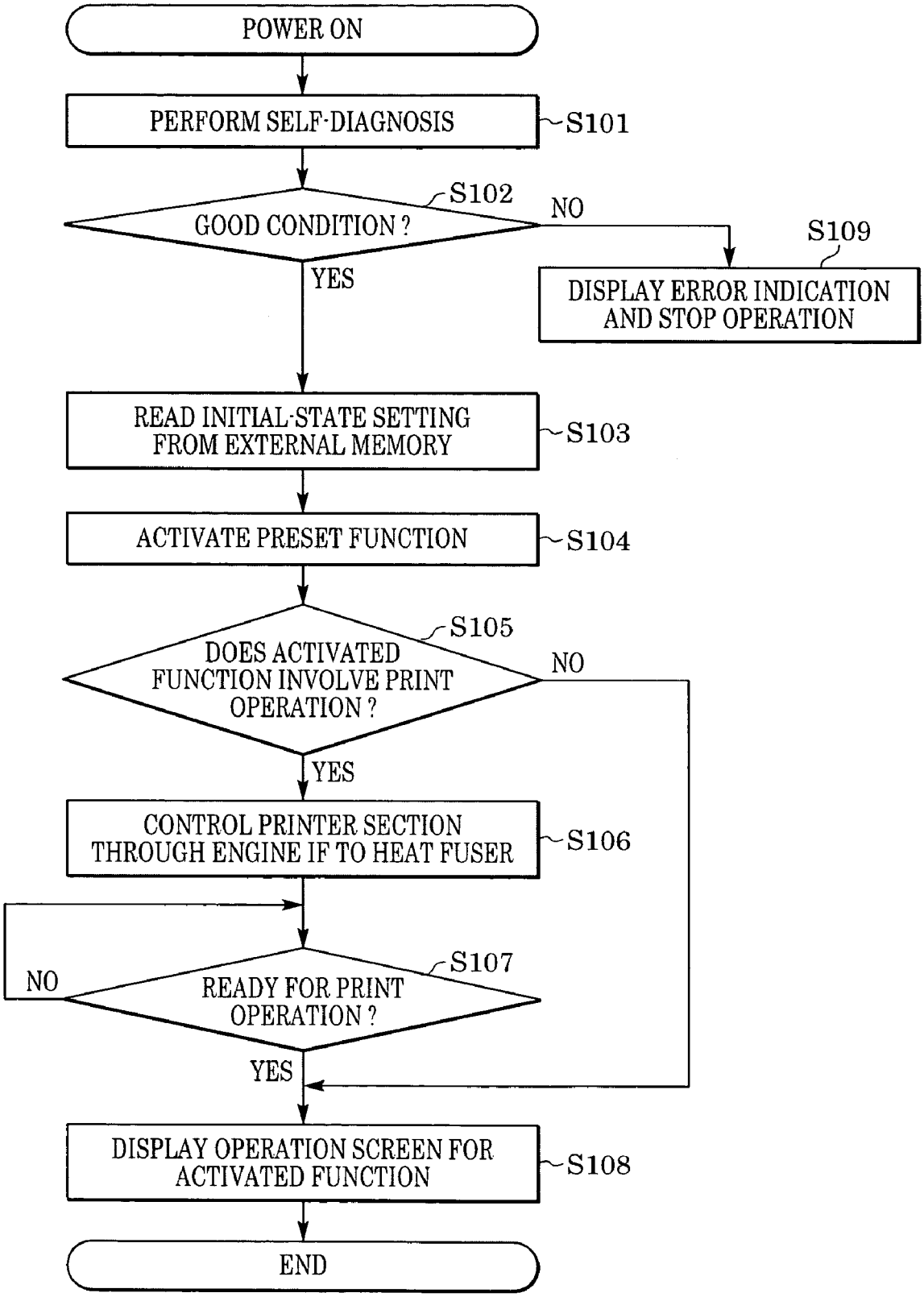

The operation at power-on will now be described with reference to FIG. 5. FIG. 5 is a flowchart showing the operation when the multifunction peripheral in FIG. 1 is turned on. The steps shown in FIG. 5 are executed by the CPU 102 of the print control section 101, according to programs stored in the ROM 103.

As shown in FIG. 5, when a user turns on the multifunction peripheral, the CPU 102 of the print control section 101 performs a self-diagnosis of the multifunction peripheral (step S1) and determines whether conditions are good or that problems, such as failure, has occurred (step S2). If any problems are found, the CPU 102 causes, via the panel interface 108, an error indication to be displayed on the control panel section 112, and stops the operation of the multifunction peripheral (step S109).

On the other hand, if it is determined from the self-diagnosis that there is no problem, the CPU 102 reads from the external memory 110 an initial-state setting indicating a function to be activated at power-on (step S103) and activates the preset function indicated by the initial-state setting (step S104). The CPU 102 determines, based on the table (shown in FIG. 4) stored in the external memory 110, whether the activated function involves the print operation (step S105). If the activated function is any of copying, printing, and fax receiving that involves the print operation, the CPU 102 instructs the printer section 111, via the engine interface 107, to heat the fuser 217 (step S106). Thus, the temperature adjustment circuit 305 in the printer section 111 regulates the amount of power supplied to the halogen heater 302 of the fuser 217 such that the surface temperature (temperature detected by the thermal sensor 304) of the fuser 217 reaches a fusing temperature in a short time.

The CPU 102 waits for the printer section 111 to become ready for the print operation, with reference to a fusing-temperature detection signal from the printer section 111 (step S107). Here, the fusing-temperature detection signal is outputted from the temperature adjustment circuit 305 in the printer section 111 and indicates whether the surface temperature of the fuser 217 has reached the fusing temperature. When the fusing-temperature detection signal indicates that the surface temperature of the fuser 217 has reached the fusing temperature, the CPU 102 determines that the printer section 111 is ready for operation. The CPU 102 then controls, via the panel interface 108, an operation screen for the activated function to be displayed on the control panel section 112 (step S108). The displayed operation screen indicates that the activated function is ready to be executed.

If the activated function is either fax sending or network data transmission that involves no print operation (step S105), the CPU 102 does not provide an instruction to heat the fuser 217 and controls, via the panel interface 108, an operation screen for the activated function to be displayed on the control panel section 112 (step S108). The operation screen indicates that the activated function is ready to be executed.

Moreover, in the present embodiment, it is determined whether or not heating of (power supply to) the fuser 217 is to be performed, depending on the function to be activated when the multifunction peripheral returns from sleep mode. Specifically, the external memory 110 stores a recovery-state setting serving as a set value, which indicates whether a function to be activated when the multifunction peripheral returns from sleep mode is the function set up as a function to be activated at power-on, or the function selected prior to entering sleep mode. When the multifunction peripheral returns from sleep mode, the appropriate function according to the recovery-state setting is activated and whether or not the fuser 217 is to be heated is determined depending on this function. Setting of a function to be activated on returning from sleep mode is made similarly to the setting of a function to be activated at power-on.

Figure 6:
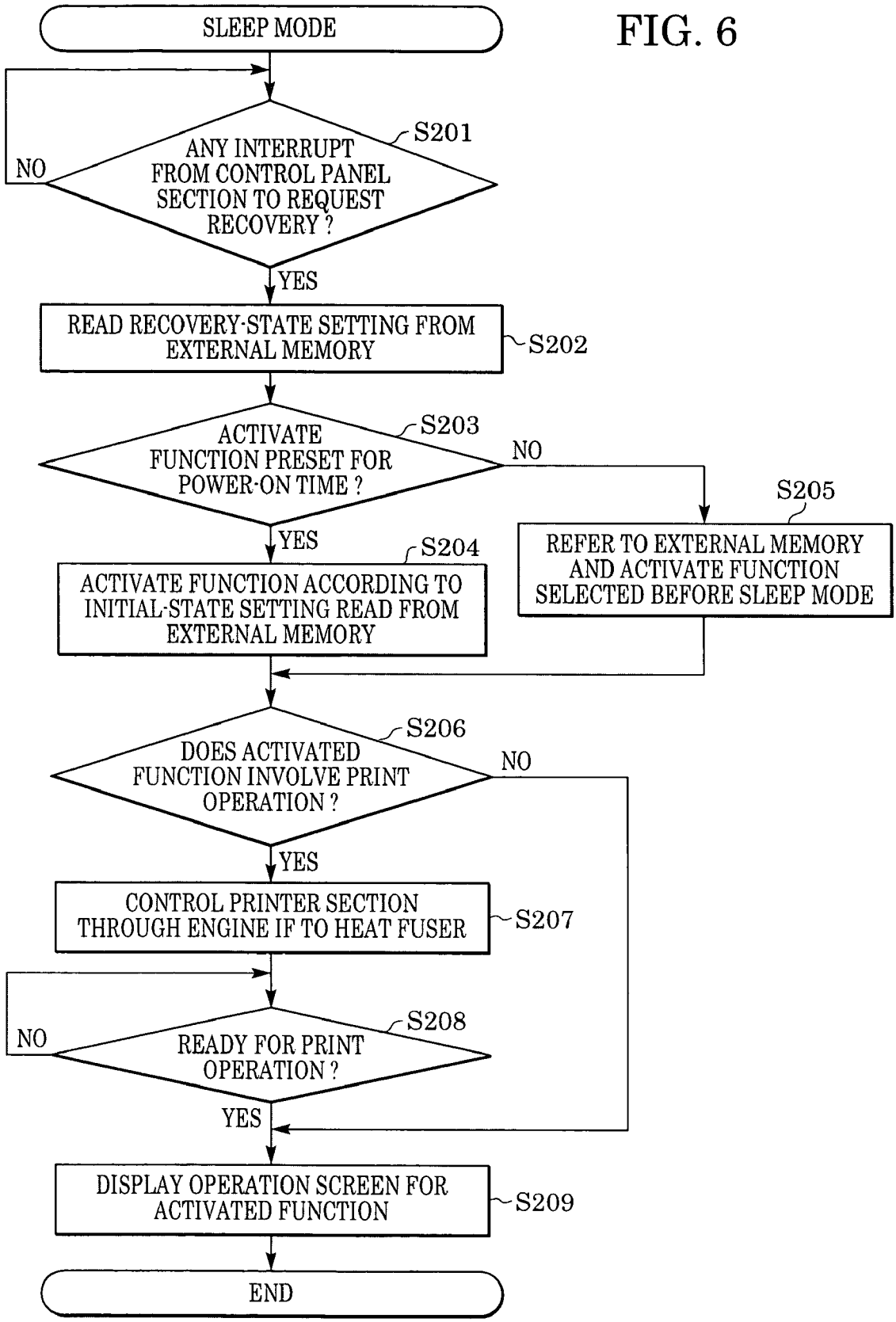
FIG. 6 is a flowchart showing the operation when the multifunction peripheral in FIG. 1 returns from sleep mode.

The operation performed after returning from sleep mode will now be described with reference to FIG. 6. FIG. 6 is a flowchart showing the operation when the multifunction peripheral in FIG. 1 returns from sleep mode. The steps shown in FIG. 6 are executed by the CPU 102 of the print control section 101, according to programs stored in the ROM 103.

As shown in FIG. 6, when the multifunction peripheral is in sleep mode, the CPU 102 waits for an interrupt from the control panel section 112 to request recovery (step S201). When a user presses an appropriate switch in the control panel section 112, an interrupt for a recovery request occurs. When this interrupt is detected, the CPU 102 reads a recovery-state setting from the external memory 110 (step S202), and it is determined whether a function set up to be activated at power-on is activated according to this recovery-state setting, or a function selected before entering sleep mode is activated (step S203).

To activate a function set up to be activated at power-on, the CPU 102 reads an initial-state setting from the external memory 110 and activates the function indicated by this setting (step S204). On the other hand, to activate a function selected before entering sleep mode, the CPU 102 refers to the external memory 110 and activates the function selected before entering sleep mode (step S205).

After activating the function described above, the CPU 102 determines, based on the table (shown in FIG. 4), whether the activated function involves the print operation (step S206). If the activated function is any of copying, printing, and fax receiving that involves the print operation, the CPU 102 instructs the printer section 111, via the engine interface 107, to heat the fuser 217 (step S207). Thus, the temperature adjustment circuit 305 in the printer section 111 regulates the amount of power supplied to the halogen heater 302 of the fuser 217 such that the temperature of the fuser 217 (surface temperature of the fuser roller 301) reaches a fusing temperature in a short time.

The CPU 102 waits for the printer section 111 to become ready for the print operation, with reference to a fusing-temperature detection signal from the printer section 111 (step S208). When the fusing-temperature detection signal indicates that the surface temperature of the fuser 217 has reached the fusing temperature, the CPU 102 determines that the printer section 111 is ready for operation. The CPU 102 then controls, via the panel interface 108, an operation screen for the activated function to be displayed on the control panel section 112 (step S209). The displayed operation screen indicates that the activated function is ready to be executed.

If the activated function is either fax sending or network data transmission that involves no print operation (step S206), the CPU 102 does not provide an instruction to heat the fuser 217 and controls, via the panel interface 108, an operation screen for the activated function to be displayed on the control panel section 112 (step S209). The operation screen indicates that the activated function is ready to be executed.

Thus, in the present embodiment, it is determined whether or not the fuser 217 is to be heated depending on the function that is set up by user operation and activated at power-on or on returning from sleep mode. That is, conditions for heating the fuser 217 can be easily changed by setting a function appropriate for the usage environment as the function to be activated at power-on or on returning from sleep mode. Moreover, conditions for heating the fuser 217 that can minimize the amount of power wasted by the fuser 217 are achieved by changing the function activated at power-on or on returning from sleep mode.

For example, in a usage environment where the frequency of use of a function, such as copying, printing, and fax receiving, which involve the print operation in the printer section 111, is very high, any of copying, printing, and fax receiving is set to be activated at power-on or on returning from sleep mode, so that the function involving the print operation in the printer section 111 can be executed immediately after the power is turned on or immediately after returning from sleep mode.

On the other hand, in a usage environment where the frequency of use of a function, such as fax sending and network data transmission, which involve no print operation in the printer section 111, is high, either fax sending or network data transmission is set to be activated at power-on or on returning from sleep mode, so that unnecessary heating of the fuser 217 can be prevented.

Moreover, if a function selected before entering sleep mode is set to be activated on returning from sleep mode, a function used with high frequency can be activated.

Second Embodiment

Figure 7:
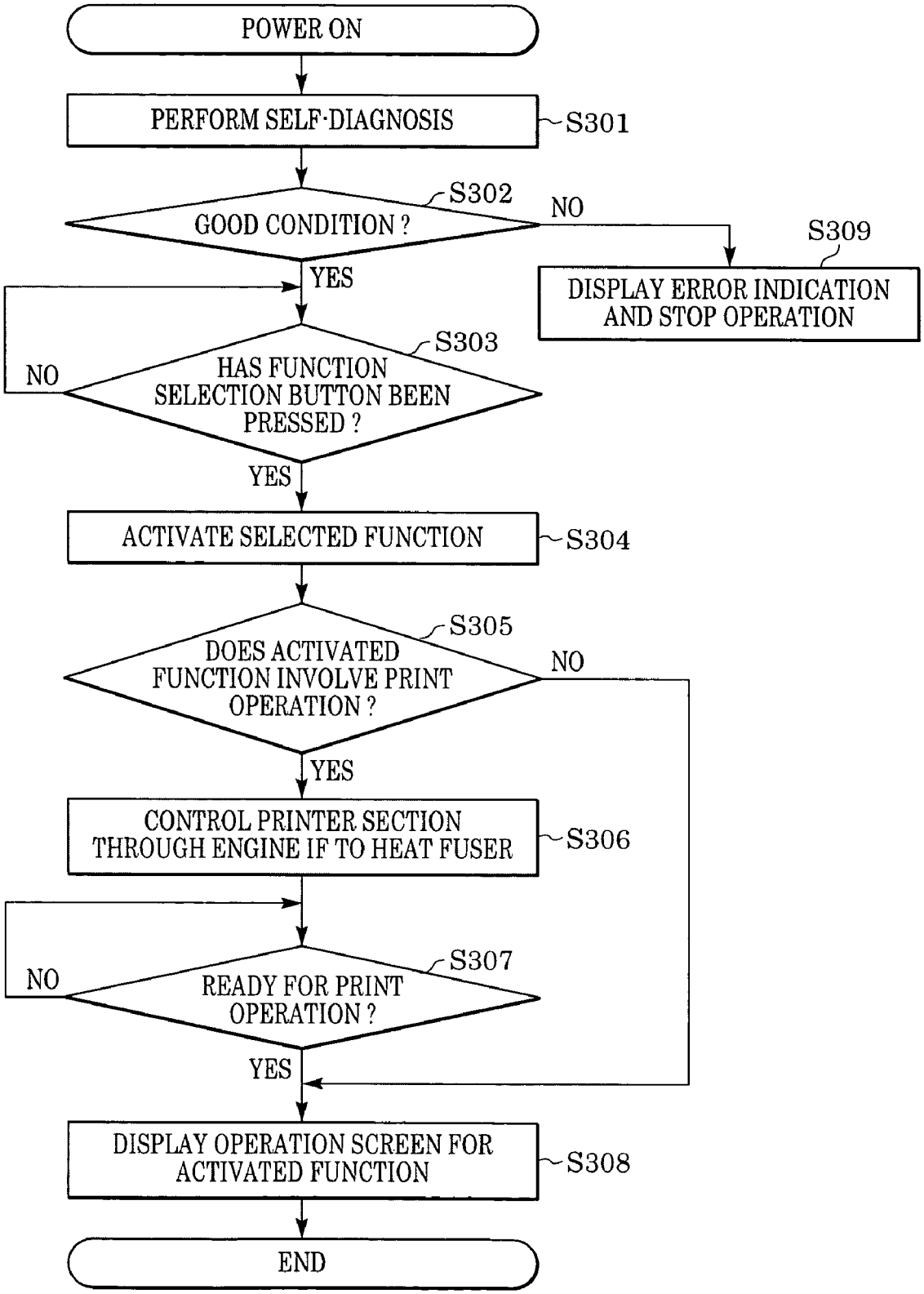
FIG. 7 is a flowchart showing the operation of a multifunction peripheral at power-on according to a second embodiment of the present invention.

A second embodiment of the present invention will now be described with reference to FIG. 7. FIG. 7 is a flowchart showing the operation of a multifunction peripheral at power-on according to the second embodiment. Components of the present embodiment are the same as those of the first embodiment and their description will be omitted. The components identical to those of the first embodiment will be indicated by the same reference numerals.

The present embodiment is different from the first embodiment in that heating of the fuser 217 does not immediately start when the multifunction peripheral is turned on. In the present embodiment, heating of the fuser 217 starts after the user selects a function to be used, depending on whether the function selected involves a print operation.

The operation of the multifunction peripheral at power-on according to the present embodiment will now be described with reference to FIG. 7. The steps shown in FIG. 7 are executed by the CPU 102 of the print control section 101, according to programs stored in the ROM 103.

As shown in FIG. 7, when the user turns on the multifunction peripheral, the CPU 102 of the print control section 101 performs a self-diagnosis of the multifunction peripheral (step S301) and determines whether conditions are good or problems, such as failure, has occurred (step S302). If any problems are found, the CPU 102 controls, via the panel interface 108, an error indication to be displayed on the control panel section 112 and stops the operation of the multifunction peripheral (step S309).

On the other hand, if it is determined from the self-diagnosis that there is no problem, the CPU 102 waits for a function selection button on the control panel section 112 to be pressed by the user (step S303). When a function selection button is pressed, the CPU 102 activates the function selected by pressing this button (step S304). Then, the CPU 102 determines, based on the table (shown in FIG. 4) stored in the external memory 110, whether the activated function involves a print operation (step S305). If the activated function is any of copying, printing, and fax receiving that involves a print operation, the CPU 102 instructs the printer section 111, via the engine interface 107, to heat the fuser 217 (step S306). Thus, the temperature adjustment circuit 305 in the printer section 111 regulates the amount of power supplied to the halogen heater 302 of the fuser 217 such that the surface temperature (temperature detected by the thermal sensor 304) of the fuser 217 reaches a fusing temperature in a short time.

The CPU 102 waits for the printer section 111 to become ready for a print operation, with reference to a fusing-temperature detection signal from the printer section 111 (step S307). When the fusing-temperature detection signal indicates that the surface temperature of the fuser 217 has reached the fusing temperature, the CPU 102 determines that the printer section 111 is ready for operation. The CPU 102 then controls, via the panel interface 108, an operation screen for the activated function to be displayed on the control panel section 112 (step S308). The displayed operation screen indicates that the activated function is ready to be executed.

If the activated function is either fax sending or network data transmission that involves no print operation (step S305), the CPU 102 does not provide an instruction to heat the fuser 217 and controls, via the panel interface 108, an operation screen for the activated function to be displayed on the control panel section 112 (step S308). The operation screen indicates that the activated function is ready to be executed.

Although not shown, heating of the fuser 217 does not start immediately after returning from sleep mode, similarly to the case when the multifunction peripheral is turned on. In the present embodiment, heating of the fuser 217 starts after the user selects a function to be used, depending on whether the selected function involves a print operation.

As described above, in the present embodiment, heating of the fuser 217 does not start at power-on or immediately after returning from sleep mode. Heating of the fuser 217 starts if the user selects a function involving a print operation, while heating of the fuser 217 does not start if the user selects a function not involving a print operation. That is, the condition for heating the fuser 217 can be changed depending on the function selected by the user. Since heating of the fuser 217 does not start if the user selects a function not involving a print operation, unnecessary heating of the fuser 217 can be prevented.

Third Embodiment

Figure 8:
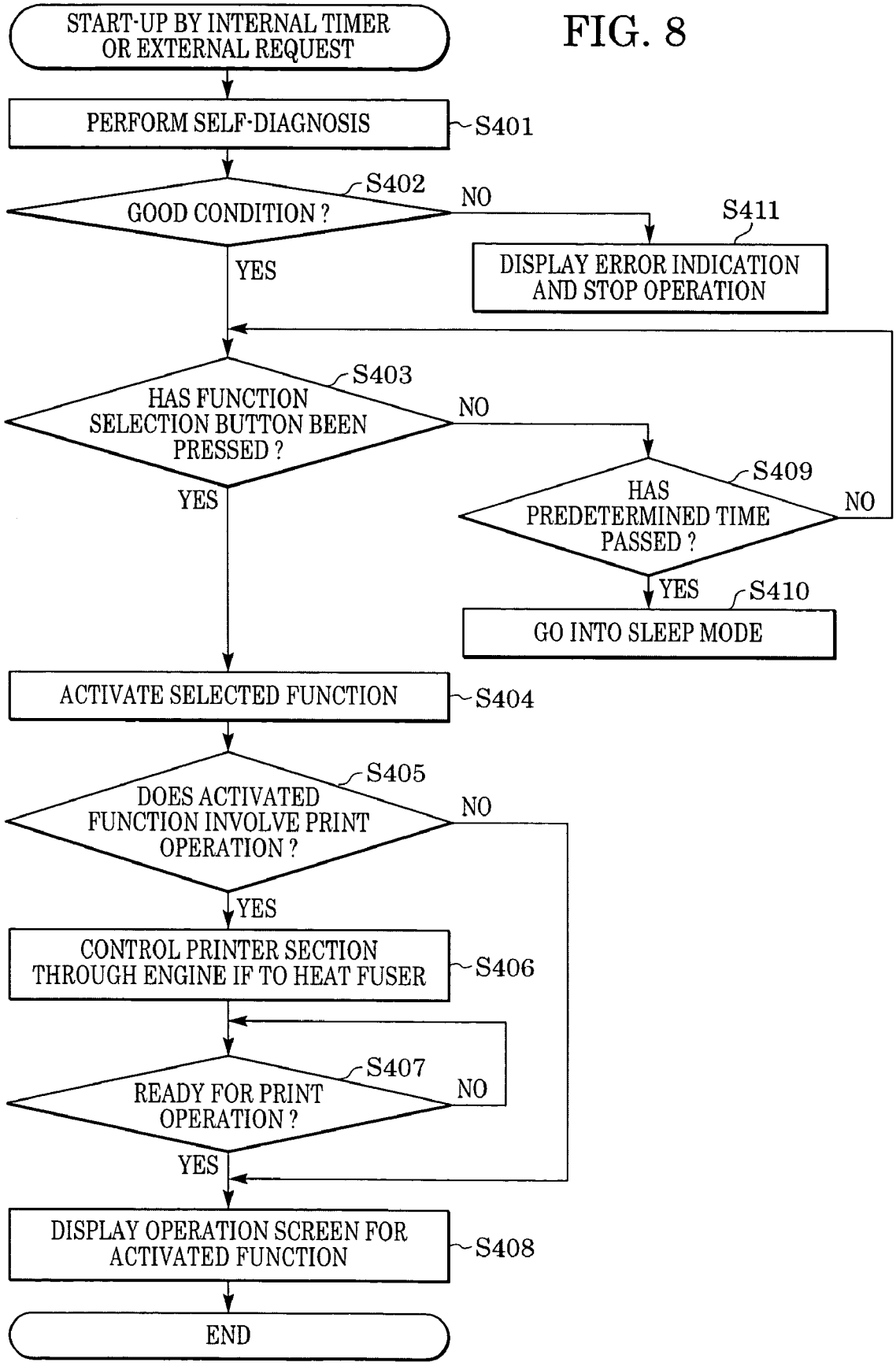
FIG. 8 is a flowchart showing the operation of a multifunction peripheral at power-on according to a third embodiment of the present invention.

A third embodiment of the present invention will now be described with reference to FIG. 8. FIG. 8 is a flowchart showing the operation of a multifunction peripheral at start-up according to the third embodiment. Components of the present embodiment are the same as those of the first embodiment and their description will be omitted. The components identical to those of the first embodiment will be indicated by the same reference numerals.

The present embodiment is different from the second embodiment in that the start-up of the multifunction peripheral is controlled by an inner timer, or is controlled externally via a network.

The operation of the multifunction peripheral at start-up according to the present embodiment will now be described with reference to FIG. 8. The steps shown in FIG. 8 are executed by the CPU 102 of the print control section 101, according to programs stored in the ROM 103.

As shown in FIG. 8, when the internal timer reaches a start-up time, or an instruction for start-up is transmitted from outside the multifunction peripheral via the network, the CPU 102 of the print control section 101 performs a self-diagnosis of the multifunction peripheral (step S401) and determines whether conditions are good or that problems, such as failure, has occurred (step S402). If any problems are found, the CPU 102 controls, via the panel interface 108, an error indication to be displayed on the control panel section 112, and stops the operation of the multifunction peripheral (step S411).

On the other hand, if it is determined from the self-diagnosis that there is no problem, the CPU 102 determines whether or not the user has pressed a function selection button on the control panel section 112 (step S403). If a function selection button has not been pressed, the CPU 102 determines whether a predetermined time has elapsed from start-up (step S409). If a predetermined time has not yet elapsed, the process returns to step S403 and the CPU 102 determines whether or not the user has pressed a function selection button. If a function selection button has not been pressed and a predetermined time has elapsed from the start-up, the CPU 102 goes into sleep mode (step S410).

If the user has pressed a function selection button before a predetermined time has elapsed, the CPU 102 activates the function selected with the function selection button (step S404). Then, the CPU 102 determines, based on the table (shown in FIG. 4) stored in the external memory 110, whether the activated function involves a print operation (step S405). If the activated function is any of copying, printing, and fax receiving that involves a print operation, the CPU 102 instructs the printer section 111, via the engine interface 107, to heat the fuser 217 (step S406). Thus, the temperature adjustment circuit 305 in the printer section 111 regulates the amount of power supplied to the halogen heater 302 of the fuser 217 such that the surface temperature (temperature detected by the thermal sensor 304) of the fuser 217 reaches a fusing temperature in a short time.

The CPU 102 waits for the printer section 111 to become ready for a print operation, with reference to a fusing-temperature detection signal from the printer section 111 (step S407). When the fusing-temperature detection signal indicates that the surface temperature of the fuser 217 has reached the fusing temperature, the CPU 102 determines that the printer section 111 is ready for operation. The CPU 102 then controls, via the panel interface 108, an operation screen for the activated function to be displayed on the control panel section 112 (step S408). The displayed operation screen indicates that the activated function is ready to be executed.

If the activated function is either fax sending or network data transmission that involves no print operation (step S405), the CPU 102 does not provide an instruction to heat the fuser 217 and controls, via the panel interface 108, an operation screen for the activated function to be displayed on the control panel section 112 (step S408). The operation screen indicates that the activated function is ready to be executed.

In the case where the start-up of the multifunction peripheral is controlled by an inner timer or is controlled externally via a network, the multifunction peripheral goes into sleep mode if no function selection button is pressed before a predetermined time has passed from start-up. Thus, unnecessary heating of the fuser 217 can be completely prevented.

Fourth Embodiment

A fourth embodiment of the present invention will now be described with reference to FIG. 9. FIG. 9 is a table of setting conditions for heating a fuser in a multifunction peripheral according to the fourth embodiment. Components of the present embodiment are the same as those of the first embodiment and their description will be omitted.

As shown in FIG. 9, in the present embodiment, a condition for heating the fuser, that is, one of "Follow the Setting", "Do Not Heat Fuser", and "Heat Fuser" can be set with respect to each of the timings, that is, when the multifunction peripheral is turned on and when it returns from sleep mode.

If "Follow the Setting" is set, a setting defining the function to be activated at power-on or on returning from sleep mode is requested, as in the first embodiment. When the function defined in the setting is activated in response to the request, heating of the fuser 217 starts depending on whether or not the function involves a print operation.

If "Do Not Heat Fuser" is set, heating of the fuser 217 does not start at power-on or on returning from sleep mode, as in the second or third embodiment. When the user selects a function to be used, heating of the fuser 217 starts depending on whether or not the function selected involves a print operation.

If "Heat Fuser" is set, heating of the fuser 217 starts regardless of the function activated at power-on or on returning from sleep mode.

The above-described conditions for heating the fuser 217 can be set, for example, on a specific screen displayed in the control panel section 112. This screen can be called up at any time with a predetermined operation. A condition for heating the fuser 217 can be set by selecting one of the above-described conditions displayed on the screen.

Thus, various conditions for heating the fuser 217 can be set by selecting one of the above-described conditions with respect to each of the timings, that is, at power-on and on returning from sleep mode. In other words, the user can set a condition for heating the fuser 217 suited for the usage environment.

Fifth Embodiment

A fifth embodiment of the present invention will now be described with reference to FIG. 10. FIG. 10 is a diagram showing a table for setting a time for transition from heating a fuser to entering sleep mode in a multifunction peripheral according to the fifth embodiment. Components of the present embodiment are the same as those of the first embodiment and their description will be omitted.

In the present embodiment, one of a plurality of different preheating temperatures for the fuser 217 can be selected and set. A time for transition from completing the operation of a function currently selected to entering sleep mode can be set with respect to each preheating temperature, with reference to an estimated time to reach the fusing temperature from the preheating temperature.

For example, when three different levels of preheating temperature (Level 1, Level 2, and Level 3) are provided as shown in FIG. 10, a table associating each preheating temperature with an estimated time to reach the fusing temperature from the preheating temperature is prepared. Here, the relationship of the three levels of preheating temperature can be expressed as Level 1>Level 2>Level 3. Then, a time for transition from completing the operation of a function currently selected to entering sleep mode can be set with respect to each preheating temperature, with reference to the estimated times shown in the above-described table, and is written in the table.

As described above, a time for transition from completing the operation of a function currently selected to entering sleep mode can be set with respect to each preheating temperature, while being associated therewith. The user can easily change the condition for heating the fuser 217, using the time set as described above, depending on the usage environment.

Although the description here has been based on the multifunction peripheral of the first embodiment, the fifth embodiment, where a time for transition from completing the operation of a function currently selected to entering sleep mode can be set with respect to each preheating temperature while being associated therewith, is applicable to an image forming apparatus that performs a single function, such as copying, printing, and fax receiving. Similar effects can be achieved by such an image forming apparatus.

Sixth Embodiment

A sixth embodiment of the present invention will now be described with reference to FIG. 11. FIG. 11 is a diagram showing a table for setting the output timing of fax data received in a multifunction peripheral according to the sixth embodiment. Components of the present embodiment are the same as those of the first embodiment and their description will be omitted.

In the present embodiment, the multifunction peripheral can be set not only to enter sleep mode during a predetermined time period, such as at night, but also to receive fax data during such a period. In the present embodiment, moreover, the output timing of the received data can be set. Specifically, as shown in the table in FIG. 11, any of "Output Immediately", "Output Periodically", and "Output at the time of the recovery" can be set as the output timing of fax data received during a predetermined time period, such as at night.

When "Output Immediately" is set, the fuser 217 in the printer section 111 is heated every time fax data is received and the data received is printed on a sheet of paper by the printer section 111. Then, if no fax data is received for a certain period of time, the temperature of the fuser 217 is lowered to a predetermined temperature.

When "Output Periodically" is set, fax data received is stored in memory. In this case, it is determined, at a predetermined interval (such as hourly), whether data received is stored in memory. If fax data received is stored in memory, the fuser 217 in the printer section 111 is heated and the data is printed on a sheet of paper by the printer section 111. This setting is effective when the amount of memory for storing received data is limited.

When "Output at the time of the recovery" is set, fax data received is stored in memory. In this case, it is determined at the time of the recovery (for example, the next morning) whether data received is stored in memory. If fax data received is stored in memory, the fuser 217 in the printer section 111 is heated and the data is printed on a sheet of paper by the printer section 111. This setting is effective when the amount of memory for storing received data is large.

The present embodiment is applicable to an image forming apparatus that performs a single function, such as fax receiving, and similar effects can be achieved by such an image forming apparatus.

If print data can be received via a network during a predetermined time period when the multifunction peripheral is in sleep mode, such as during the night, the output timing of print data received can be set similarly to the output timing of fax data received. The mechanism of the present embodiment, in this case, is applicable to an image forming apparatus that solely serves as a printer.

The present invention can also be achieved by supplying a storage medium (or a recording medium) storing program codes of software for performing the functions of the embodiments to a system or an apparatus, reading the program codes stored in the storage medium by a computer (or, for example, a CPU or an MPU) of the system or the apparatus, and executing the program codes. In this case, the program codes read from the storage medium implement the functions of the embodiments and the storage medium storing the program codes constitute the present invention.

Besides the case where the functions of the embodiments are implemented by executing the program codes read by a computer, the present invention includes the case where, for example, an operating system (OS) running on the computer carries out some or all of the processes as designated by the program codes, thereby implementing the functions of the embodiments described above.

In addition, the present invention includes the case where, after the program codes read from the storage medium are written in a function extension card mounted in the computer or in a memory incorporated in a function extension unit connected to the computer, the function extension card and, for example, a CPU of the function extension unit, carries out some or all of the processes as designated by the program codes, thereby implementing the functions of the embodiments described above.

While the present invention has been described with reference to what are presently considered to be the embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An apparatus operable to perform functions including a function involving a printing operation on a print medium and a function not involving a printing operation, comprising:

an image forming unit operable to form an image on the print medium in the printing operation;

a fuser heating the image formed on the print medium so as to fuse the image on the print medium;

an instruction receiving unit receiving an instruction to set the apparatus to power-on from a predetermined state including power-off and sleep-mode;

a memory storing initial setting information indicating the function to be activated among the plurality of functions when the apparatus is set to power-on from the predetermined state;

a determiner determining the function to be activated by the apparatus based on the initial setting information stored in the memory, responsive to the instruction receiving unit receiving the instruction to set the apparatus power-on; and a controller activating the function determined by the determiner and controlling the fuser to start heating when the function to be activated determined by the determiner is the function involving the printing operation and not to start heating when the function to be activated determined by the determiner is the function not involving the printing operation.

2. The apparatus according to claim 1, further comprising a setting unit allowing a user to input the setting information on the function to be activated, wherein the memory stores the setting information inputted by the user via the setting unit.

3. The apparatus according to claim 1, further comprising a setting unit allowing setting of preheating temperature of the fuser, estimated time to heat the fuser to a fusing temperature from the preheating temperature, and a transition time from completion of the function to the sleep-mode of the apparatus.

4. The apparatus according to claim 1, wherein the memory stores timing information on an activation time to activate the function involving the printing operation, wherein the activator controller activates the function involving the printing operation at the activation time.

5. A method for controlling an apparatus operable to perform functions, including a function involving a printing operation on a print medium and a function not involving a printing operation, and having a fuser heating the image formed on the print medium so as to fuse the image on the print medium in the printing operation, the method comprising the steps of:

receiving an instruction to set the apparatus power-on from a predetermined state including power-off and sleep-mode:

responsive to receiving the instruction for setting the apparatus to power-on at the receiving step, determining the function to be activated by the apparatus based on initial setting information indicating the function to be activated among the plurality of functions which are stored in a memory when the apparatus is set to power-on front the predetermined state;

activating the function determined in the determining step;

heating the fuser, in the ease that the determined function to be activated in the determining step involves the printing operation: and controlling the fuser not to start heating in the case that the determined function to be activated in the determining step does not involve the printing operation.

6. The method for controlling the apparatus according to claim 5 further comprising the step of storing in the memory setting information on the function to be activated at recovery from the sleep-mode of the apparatus.

7. The method for controlling the apparatus according to claim 6, further comprising the stop of setting the function to be activated at recovery from the sleep-mode of the apparatus.

8. The method for controlling the apparatus according to claim 5, further comprising setting a preheating temperature of the fuser, an estimated time to heat the fuser to a fusing temperature from the preheating temperature, and a transition time from completion of the function to the sleep-mode of the apparatus.

9. The method for controlling the apparatus according to claim 5, further comprising storing timing information on an activation time to activate the function involving the printing operation, wherein the activation step includes activating the function involving the printing operation at the activation time.

10. A program stored on a recording medium for performing steps of the method for controlling the apparatus according to claim 5.

11. A recording medium storing a program performing the steps of the method for controlling the apparatus according to claim 5.

12. An apparatus operable to perform a plurality of functions including a function involving a printing operation on a print medium and a function not involving printing operation, comprising:

an image forming unit operable to form an image on the print medium in the printing operation;

a fuser heating the image formed on the print medium so as to fuse the image on the print medium;

a power-on instruction receiving unit receiving an instruction to set the apparatus to power-on from a predetermined state including power-off and sleep-mode;

a selecting instruction receiving unit receiving an instruction to select the function to be activated by the apparatus among the plurality of functions after receiving the instruction to set the apparatus to power-on at the power-on instruction; and a controller controlling the finer not to start heating during a period from receiving the instruction to set the apparatus to power-on at the power-on instruction receiving unit until receiving the instruction to select the function to be activated at the selecting instruction receiving unit, to start heating when the function that the selecting instruction receiving unit receives the instruction to select is the function involving the printing operation, and not to start heating when the function that the selecting instruction receiving unit receives the instruction to select is the function not involving the printing operation.

13. A method for controlling an apparatus operable to perform a plurality of functions, including a function involving a printing operation on a print medium and a function not involving printing operation, and having a fuser heating the image formed on the print medium so as to fuse the image on the print medium in the printing operation, the method comprising the steps of:

receiving an instruction to set the apparatus to power-on from a predetermined state including power-off and sleep-mode;

receiving an instruction to select the function to be activated by the apparatus among the plurality of functions after receiving the instruction to set the apparatus to power-on at the power-on instruction; and controlling the fuser not to start heating during a period from receiving the instruction to set the apparatus to power-on until receiving the instruction to select the function to be activated, to start heating when the function receiving the instruction to be selected is the function involving the printing operation, and not to start heating when the function receiving the instruction to be selected is the function not involving the printing operation.

14. A program stored on a recording medium for performing steps of the method for controlling the apparatus according to claim 13.

15. A recording medium storing a program performing the steps of the method for controlling the apparatus according to claim 13.

* * * * *